US006418920B1

(12) United States Patent
Marr

(10) Patent No.: US 6,418,920 B1
(45) Date of Patent: Jul. 16, 2002

(54) VALVES FOR ACTUATING THE FLOW OF PRESSURIZED FLUIDS AND DEVICE CONTAINING SAME

(76) Inventor: Michael D. Marr, 251 W. Buist Ave., Phoenix, AZ (US) 85041

( * ) Notice: Subject to any disclaimer, the term of this patent is extended or adjusted under 35 U.S.C. 154(b) by 0 days.

(21) Appl. No.: 09/628,267

(22) Filed: Jul. 28, 2000

(51) Int. Cl.[7] ..... F41B 11/00
(52) U.S. Cl. ..... 124/74; 124/76; 124/73
(58) Field of Search ..... 124/16, 63, 64, 124/69, 73, 76, 60, 59, 61, 74; 60/407; 222/491; 137/455, 505; 55/417

(56) References Cited

U.S. PATENT DOCUMENTS

| | | | | | |
|---|---|---|---|---|---|
| 5,515,838 | A | * | 5/1996 | Anderson | 124/76 |
| 5,613,518 | A | * | 3/1997 | Rakieski | 137/513.5 |
| 5,771,875 | A | * | 6/1998 | Sullivan | 124/72 |
| 5,791,328 | A | * | 8/1998 | Alexander | 124/76 |
| 5,913,303 | A | * | 6/1999 | Kotsiopoulos | 124/31 |
| 6,029,945 | A | * | 2/2000 | Blanke | 251/15 |
| 6,065,460 | A | * | 5/2000 | Lotuaco, III | 124/72 |
| 6,112,734 | A | * | 9/2000 | Kunimoto | 124/73 |
| 6,189,745 | B1 | * | 2/2001 | Frank | 222/509 |
| 6,233,928 | B1 | * | 5/2001 | Scott | 60/407 |

* cited by examiner

*Primary Examiner*—Charles T. Jordan
*Assistant Examiner*—Gabriel S Sukman
(74) *Attorney, Agent, or Firm*—Schmeiser, Olsen & Watts

(57) ABSTRACT

A valve is disclosed that generally includes: a valve body that preferably has at least three exhaust ports, which are preferably located in a recess, thereby allowing a larger volume of fluid to flow out from the passageway and providing less restrictive fluid flow; a valve stem with preferably a predetermined diameter along its length to take up less volume in the passageway and interfering less with the flow of pressurized fluid; a preferably aerodynamic seal that provides for less pressure on the seal, more fluid to flow between the valve chamber bore and the passageway, and less turbulence, thereby providing increased fluid flow and allowing the valve to be utilized with both high and low fluid pressure; and a strikable portion to regulate the valve without reliance on such external factors as fluid pressure, valve return spring pressure, striker spring pressure, and striker weight. The valve is preferably further regulated by a spring that is abutted between the strikable portion and the valve body, the spring and strikable portion forming a rear spring assembly that causes the valve stem to travel a constant distance, thereby providing a constant amount of fluid volume relevant to fluid pressure through the valve, further increasing fluid flow and volume, and further decreasing acoustic irregularities. Furthermore, the valve might include a plurality of channels that preferably communicate with the recess, thereby allowing bi-directional movement of fluid through the valve, a recycling of fluid pressure, and the use of low fluid pressures.

28 Claims, 6 Drawing Sheets

VALVES FOR ACTUATING THE FLOW OF PRESSURIZED FLUIDS AND DEVICE CONTAINING SAME

BACKGROUND OF THE INVENTION

1. Technical Field

This invention relates to the field of pressurized fluids. More specifically, the invention relates to new and useful improvements in valves for actuating the flow of pressurized fluids and a device containing same.

2. Background Art

Assorted types of guns that project paintballs or other projectiles have been developed and used in many applications. Generally, these paintball type guns use valves that control the flow of pressurized fluid employed to propel paintballs. Such propellant fluids might be carbon dioxide, nitrogen, compressed air, or other high pressure gases. An example is U.S. Pat. No. 5,791,328, issued Aug., 11, 1998 to Aaron K. Alexander. U.S. Pat. No. 5,791,328 employs a valve for use with a paintball gun that includes a valve body with a flow path through it, a valve stem that passes through the body with one end of the valve stem itself acting as a striking surface, and a cup seal with radial guide legs that slidably contact the valve chamber bore of a paintball gun, the cupseal being attached to the other end of the valve stem. However, there are problems with the current valves, including the valve from U.S. Pat. No. 5,791,328.

SUMMARY OF THE INVENTION

The preferred embodiments of the present invention solve and overcome these problems by providing an aerodynamic seal that allows more fluid to flow between a valve chamber bore and the valve's passageway. Additionally, the aerodynamic structure of the seal creates less turbulence, thereby increasing a scavenging effect and providing more fluid flow into the valve body. Moreover, when the seal mates with the seal seat on the valve body and the valve is shut, fluid pressure on the seal is reduced because of the aerodynamic shape of the seal.

Additional embodiments provide a rear spring assembly that includes a spring that is placed between a strikable portion and the valve body. The strikable portion couples to one end of a valve stem and the other end of the valve stem couples to the seal. By placing the spring on the rear spring assembly, the spring is not located in the valve chamber bore, thereby further increasing fluid flow and volume, and decreasing acoustic irregularities. Moreover, the strikable portion itself creates a constant travel stop for the seal. This provides a constant amount of fluid volume through the valve relevant to fluid pressure.

Additionally, the valve body preferably contains multiple exhaust ports, and these exhaust ports are preferably located in a circumferential recess in the valve body. This allows a larger volume of fluid to pass from the passageway of the valve body to an exhaust bore and provides less restrictive fluid flow. Moreover, providing multiple exhaust ports does not require the valve body to be fixed in a particular way in relationship to the exhaust bore.

In one of the most preferred embodiments, the combination of these features decrease the amount of force necessary to actuate the valve, allow the rear spring to be relatively weak, yet reduce fluid "pop" created by supersonic fluid as it flows past the valve, and allow the valve to remain fully functional over a wide variety of fluid pressures. Additional features and advantages of the embodiments of the present invention are discussed below.

The other of the most preferred embodiments again combines all of the foregoing features and provides all of the previous advantages, yet preferably provides a plurality of channeled apertures on the outside circumference of the valve body that preferably communicate with a circumferential recess on the valve body and a striker chamber bore. The preferred channeled apertures allow the dissipation of fluid pressure from a striker chamber bore forward into the recess in the valve body, thereby eliminating any cushion of fluid pressure that might stop the striker from sufficiently or effectively striking a strikable portion attached to the valve stem. In addition, the channeled apertures allow a striker chamber exhaust vent to be eliminated, thereby allowing recycling of fluid pressure and not a wasting of fluid pressure by dissipation out the striker chamber exhaust vent. Moreover, the channeled apertures allow the use of low fluid pressures to re-cock the striker because by allowing blowback fluid to dissipate forward through the channels into the valve body, more fluid will be blown back through the channels when the valve is next open.

The foregoing and other features and advantages of the invention will be apparent from the following more particular description of the preferred embodiments of the invention, as illustrated in the accompanying drawings.

BRIEF DESCRIPTION OF THE DRAWINGS

The preferred embodiments of the present invention will hereinafter be described in conjunction with the appended drawings, where like designations denote like elements, and.

DETAILED DESCRIPTION OF THE PREFERRED EMBODIMENTS

As discussed above, the preferred embodiments of the present invention relate to valves for actuating the flow of pressurized fluids and devices containing the same. A more complete discussion of the problems associated with prior art valves that are used for actuating the flow of pressurized fluids follows in the Overview section. The preferred embodiments of the present invention will then be discussed in the Detailed Description.

1. Overview

Figure 4:
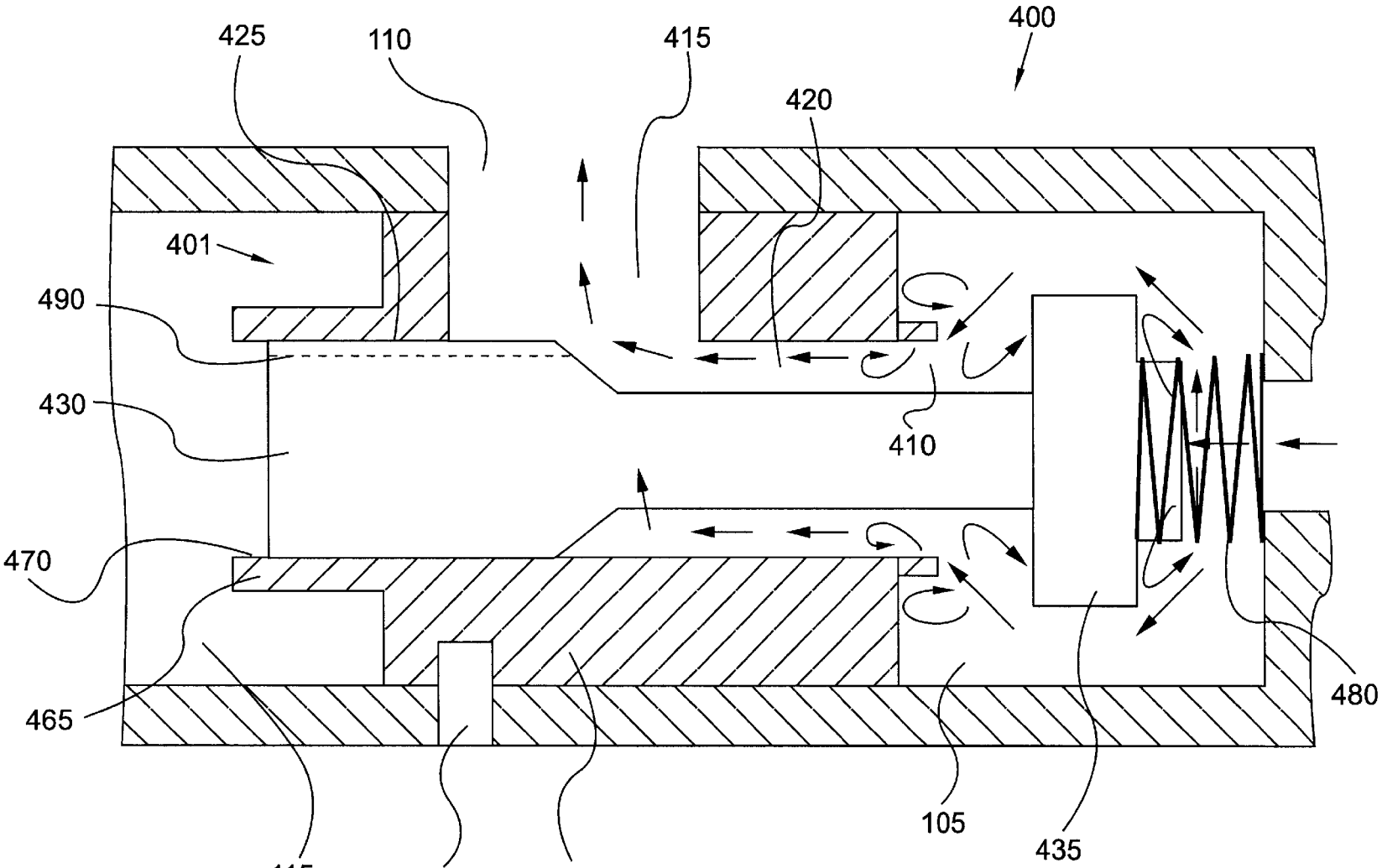
FIG. 4 (Prior Art)
FIG. 4 is a side view of a prior art valve located within a partially broken away cross section of a compressed fluid powered device depicting both a valve stem traveling into a valve body a distance after being struck and the flow of compressed fluid.
Figure 5:
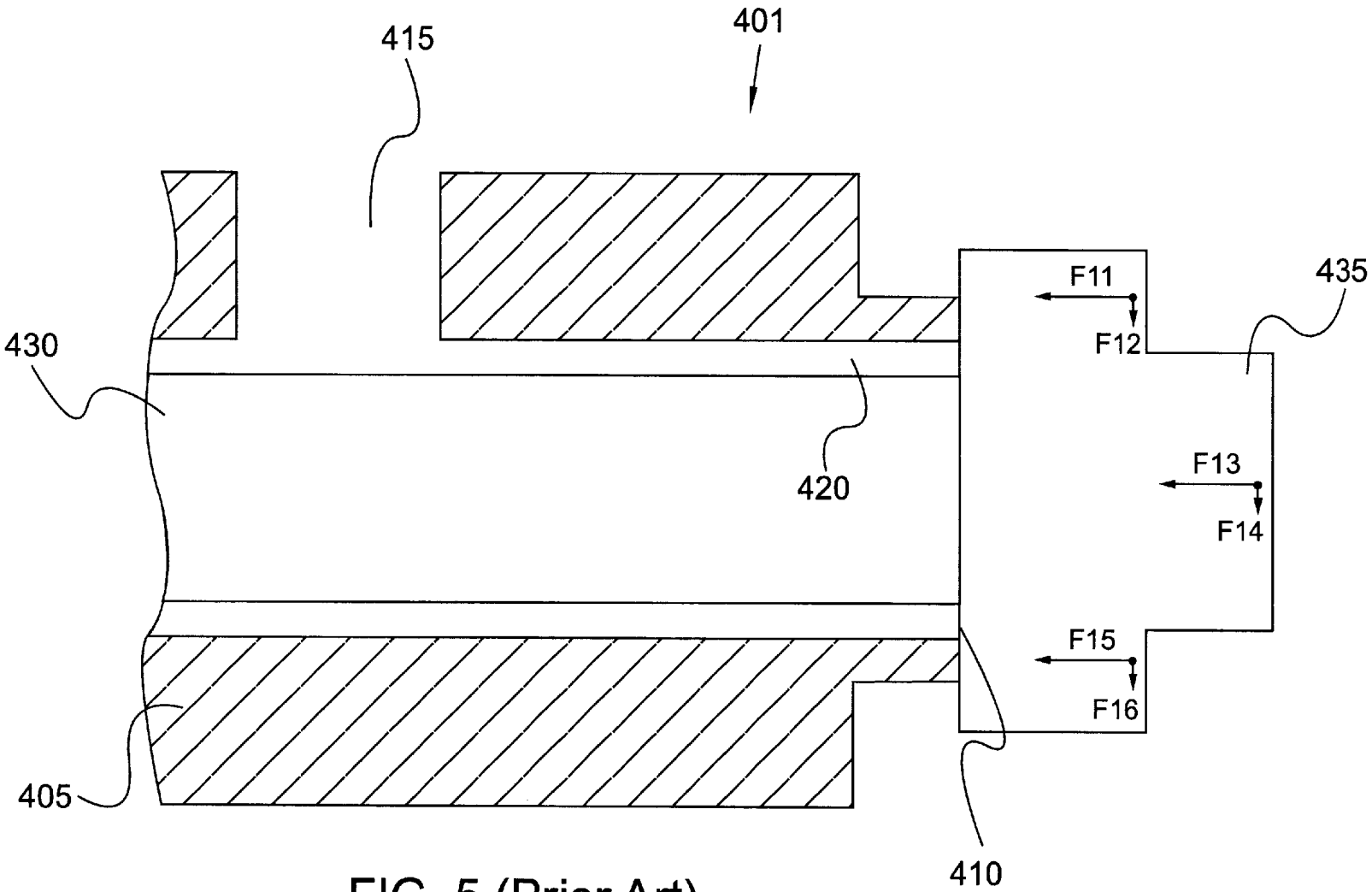
FIG. 5 (Prior Art)
FIG. 5 is a partially broken away cross sectional side view depiction of a cupseal of a prior art valve and forces F11–F16 exerted on the cupseal from compressed fluid flow.

There are problems with the current valves that are used in paintball type guns to control the flow of pressurized fluid used to propel paintballs. Reference is made to the prior art valve depicted in FIGS. 4–5 to illustrate and explain these problems. Portion 400 of FIG. 4 is a side view of prior art valve 401 located within a partially broken away cross section of a compressed fluid powered device, similar to compressed fluid powered devices 100 of FIG. 1 and 500 of FIG. 6. Valve 401 includes valve body 405, intake port 410, exhaust port 415, passageway 420, two tiered valve stem 430, cupseal 435, support nose 465, and support nose bore 470. Valve 401 also utilizes valve return spring 480 in valve chamber bore 105 that is retained between cupseal 435 and a wall of valve chamber bore 105. FIG. 5 is a partially broken away cross sectional side view depiction of prior art valve 401 and forces F11–F16 exerted on cupseal 435 from compressed fluid flow.

In reference to FIGS. 4–5, valve 401 and the valve of U.S. Pat. No. 5,791,328 have certain drawbacks. Specifically, using valve 401 in FIG. 4 as the example, when valve stem 430 itself is struck, valve stem 430 travels an erratic distance, especially when fluid pressure decreases. Related to the erratic distance valve stem 430 travels when struck, valve stem 430 has a two-tiered diameter along its length. Therefore, when valve stem 430 is struck, the larger diameter portion of valve stem 430 travels into passageway 420, thereby decreasing the volume inside passageway 420. Thus, the distance valve stem 430 travels and, therefore, the distance cupseal 435 opens is not regulated, but depends on such factors as fluid pressure, valve return spring 480 pressure, striker spring pressure, and striker weight (see striker 135 of FIG. 1 for an example).

Moreover, if cupseal 435 has radial guide legs, like in U.S. Pat. No. 5,791,328, that slidably contact valve chamber bore 105 walls, less fluid will flow from valve chamber bore 105 in to passageway 420. Additionally, the non-aerodynamic structure of cupseal 435 and the cupseal of U.S. Pat. No. 5,791,328 creates turbulence as illustrated by the fluid flow in FIG. 4, thereby decreasing a scavenging effect and reducing fluid flow into passageway 420. Furthermore, as depicted in FIG. 5, when cupseal 435 and the cupseal of U.S. Pat. No. 5,791,328 seat with valve body 405 and valve 401 is shut, fluid pressure on cupseal 435 and the cupseal of U.S. Pat. No. 5,791,328 is amplified because of the non-aerodynamic shape of either cupseal. This is because forces F11, F13, and F15 are high and in the opposite direction of cupseal 435 travel when opened. In addition, cupseal 435 and the cupseal with radial guide legs of U.S. Pat. No. 5,791,328 have an increased surface area which makes them resistant to opening at high fluid pressure.

Still referring to FIGS. 4–5, retaining pin 485 must be utilized to keep valve body 405 positioned so exhaust port 415 stays in line with exhaust bore 110. The valve of U.S. Pat. No. 5,791,328 also requires the use of a retaining pin or screw. Valve 401 and the valve of U.S. Pat. No. 5,791,328 also utilize valve return spring 480 between cupseal 435 and a wall of a valve chamber bore 105. Valve return spring 480 is utilized to aid in controlling dwell time—the amount of time cupseal 435 remains open. The lighter valve spring 480 is, the longer the dwell time. However, valve return spring 480 decreases the volume of valve chamber bore 105 and also provides acoustical irregularities. Furthermore, cupseal 435 or the cupseal of U.S. Pat. No. 5,791,328 with radial guide legs creates both aerodynamic and acoustical irregularities. Thus, the combination of cupseal 435, or the cupseal of U.S. Pat. No. 5,791,328, and valve return spring 480 generate a high level of noise—fluid "pop" created by supersonic fluid as it flows past cupseal 435 into valve body 405—when valve 401 is used in conjunction with devices similar to device 100 of FIG. 1 or device 500 of FIG. 6.

Referring again to FIG. 4, valve stem 430 might have a small flat slot milled in its larger diameter tier, as depicted by dashed line 490. Furthermore, valve 401 might have small diameter rear blow-back ports extending from passageway 420 through and out valve body 405, the blow back ports being around support nose 465. When valve 401 is open, the flat slot or the blow back ports allow some fluid to flow back into striker chamber bore 115, thereby creating fluid pressure in striker chamber bore 115 to re-cock striker 135. However, at low fluid pressures valve 401 utilizing either a small slot in valve stem 430 or rear blow-back ports positioned around support nose 465 cannot re-cock striker 135 by fluid blow-back. Lighter striker spring sets might be used to allow the blow-back of low fluid pressure to re-cock striker 135. However, when lighter spring sets are utilized striker 135 does not have sufficient force to pop open valve 401.

Moreover, neither the small slot in valve stem 430, nor the small diameter blow-back ports around support nose 465 allow fluid pressure to be released from striker chamber bore 115, thereby creating a cushion of fluid pressure in striker chamber bore 115 that stops striker 135 from sufficiently or effectively striking valve stem 430. There is simply not enough time to dissipate fluid through either the slot or blow-back ports due to their small sizes. A striker chamber exhaust vent might be provided to dissipate fluid pressure in striker chamber bore 115 after blow-back occurs due to either the slot or the blow-back ports. However, a striker chamber exhaust vent does not solve the problem of re-cocking striker 135 at low fluid pressures as described previously. Moreover, because a striker chamber exhaust vent dissipates blow-back fluid pressure, the fluid pressure is wasted and recycling of fluid pressure is not allowed.

2. Detailed Description

Figure 2:
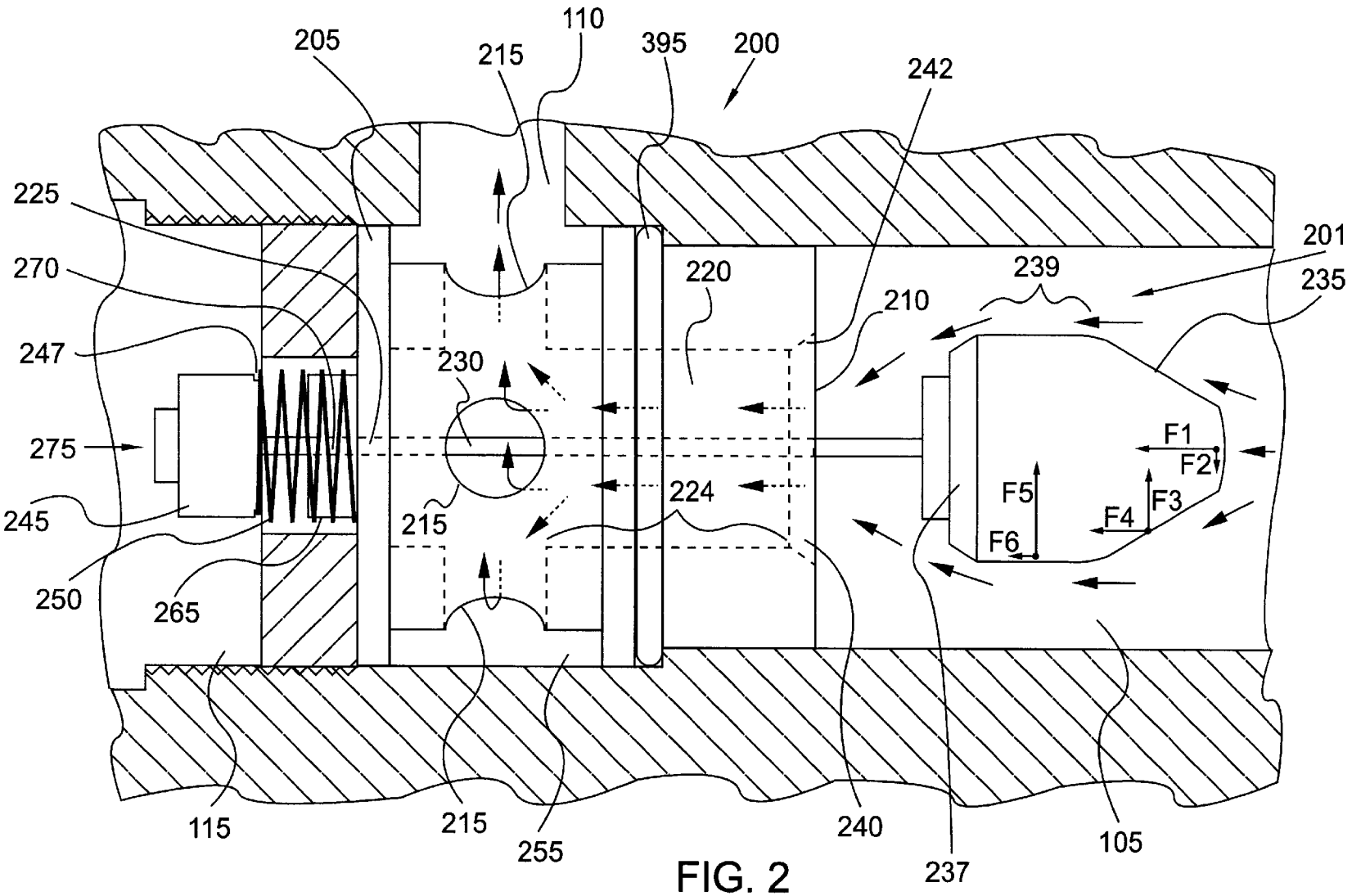
FIG. 2 is a side view of a preferred embodiment of the invention located within a partially broken away cross section of the compressed fluid powered device of FIG. 1, in which the flow of compressed fluid and forces F1–F6 exerted on the seal are depicted.
Figure 3:
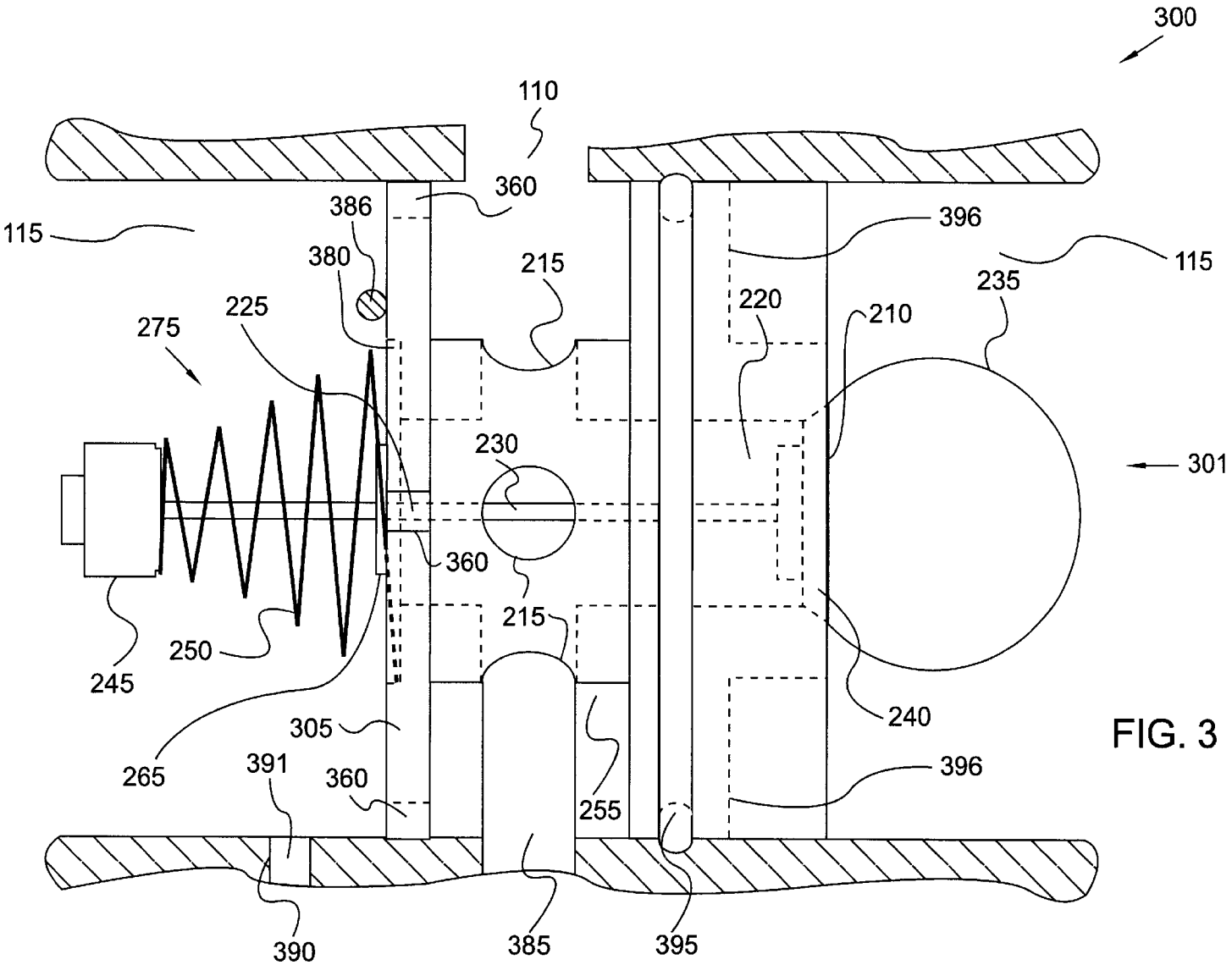
FIG. 3 is a side view of another preferred embodiment of the invention.

What is needed is a valve that overcomes the foregoing problems. The two most preferred embodiments of the present invention solve and overcome all of these problems. Referring generally to FIGS. 2 and 3, valves 201 and 301 generally include valve bodies 205 or 305 respectively, a valve stem 230, a seal 235, and a strikable portion 245. Valve bodies 205 and 305 include an intake port 210, at least one exhaust port 215, a passageway 220 between intake port 210 and at least one exhaust port 215, and an internal bore 225 opposite intake port 210. Valve stem 230 has a first end and a second end, and is slidably received in internal bore 225 and extends at least partially through passageway 220. Seal 235 is coupled to the second end of valve stem 230, wherein seal 235 is capable of seating with or unseating from a seal seat 240 on intake port 210. Strikable portion 245 is coupled to the first end of valve stem 230, strikable portion 245 sized larger than internal bore 225, whereby strikable portion 245 will contact valve body 205 after valve stem 230 travels a distance. Valve 301, in addition to the above also has at least one aperture 360 that communicates with the valve body and that will allow bi-directional fluid flow through valve 301.

One advantage of valves 201 and 301 is that they are regulated without reliance on such external factors as fluid pressure, valve return spring pressure, striker spring pressure, and striker weight. Valves 201 and 301 are regulated by strikable portion 245 that is coupled to valve stem 230 which causes valve stem 230 to travel a constant distance, thereby providing a constant amount of fluid volume through valves 201 and 301. Valves 201 and 301 are preferably further regulated by a spring 250 between strikable portion 245 and valve bodies 205 and 305. The combination of spring 250 and strikable portion 245 creates preferred rear spring assembly 275. Strikable portion 245 couples to one end of valve stem 230. Spring 250 is between strikable portion 245, rear support appendage 265, and valve bodies 205 and 305. By placing spring 250 on rear spring assembly 275, spring 250 is not located in valve chamber bore 105, but rather in striker chamber bore 115, thereby further increasing fluid flow and volume and decreasing acoustic irregularities within valve chamber bore 105.

Another advantage of valves 201 and 301 is seal 235. Seal 235 is preferably smooth and aerodynamically shaped and compatibly seats with seal seat 240, which preferably includes small sized circumferential bevel portion 242 on the inner concentric surface of intake port 210 that self centers and seats seal 235. Therefore, there is less pressure on the preferable aerodynamic seal 235 because contact surface area is decreased. Furthermore, the preferable aerodynamic seal 235 allows more fluid to flow between valve chamber bore 105 and passageway 220. One reason for this, as depicted in FIG. 2, is that the preferable aerodynamic structure of seal 235 creates less turbulence, thereby increasing a scavenging effect and providing more fluid flow through intake port 210 and into passageway 220. Moreover, when seal 235 mates with seal seat 240 and valve 201 is shut, fluid pressure on seal 235 is reduced because of its preferred aerodynamic shape. Thus, valves 201 and 301 can be utilized with both high and low fluid pressure. In addition, there is a dramatic decrease in noise level—fluid "pop" created by supersonic fluid as it flows past the seal 235 and into valve body 205—with preferred aerodynamic seal 235, especially with the lack of valve return spring 480 of FIG. 4 that would also cause acoustic irregularities.

Yet another advantage of valves 201 and 301 is valve stem 230. Valve stem 230 preferably has a predetermined reduced diameter along its length as compared to the two tiered diameter of prior art valve stem 430 of FIG. 4, by way of example, thereby taking up less volume in passageway 220 and interfering less with the flow of pressurized fluid.

Still another advantage of valves 201 and 301 is valve bodies 205 and 305 respectively. Preferably, valve bodies 205 and 305 have at least three exhaust ports 215, which are preferably located in recess 255. This allows a larger volume of fluid to pass from passageway 220 to exhaust bore 110 and provides less restrictive fluid flow. Moreover, providing at least three exhaust ports 215 does not require valve body 205 to be fixed in relationship to exhaust bore 110. Thus, valve body 205 can rotate and a retaining pin, such as retaining pin 485 of FIG. 4, is not required to hold valve body 205 in place. Furthermore, valve bodies 205 and 305 preferably have a larger diameter to better mount in a valve chamber bore 115 of compressed fluid powered device 100 of FIG. 1 or compressed fluid powered device 500 of FIG. 6.

One of the most preferred embodiments, valve 201, combines all of the foregoing features and provides all of the previous advantages, such as allowing spring 250 to be relatively weak, reducing fluid "pop" created by supersonic fluid as it flows past seal 235 through intake port 210 and into passageway 220, decreasing the amount of force necessary to actuate the valve, and allowing the valve to remain fully functional over a wide variety of fluid pressures.

The other most preferred embodiment, valve 301, again combines all of the foregoing features and provides all of the previous advantages, yet preferably provides plurality of channeled apertures 360 on the outside circumference of valve body 305 that preferably communicate with circumferential recess 255 and striker chamber bore 115. Preferred channeled apertures 360 allow the dissipation of fluid pressure from striker chamber bore 115 forward into recess 255 preferably, thereby eliminating any cushion of fluid pressure that might stop striker 135 from sufficiently or effectively striking strikable portion 245. In addition, preferred channeled apertures 360 allow a striker chamber exhaust vent to be eliminated, thereby allowing recycling of fluid pressure and not a wasting of fluid pressure by dissipation out the striker chamber exhaust vent. Moreover, preferred channeled apertures 360 allow the use of low fluid pressures to re-cock striker 135 because by allowing blow-back fluid to dissipate forward through preferred channeled apertures 360 into valve body 305, more fluid will be blown back through preferred channeled apertures 360 when valve 301 is next open.

Figure 1:
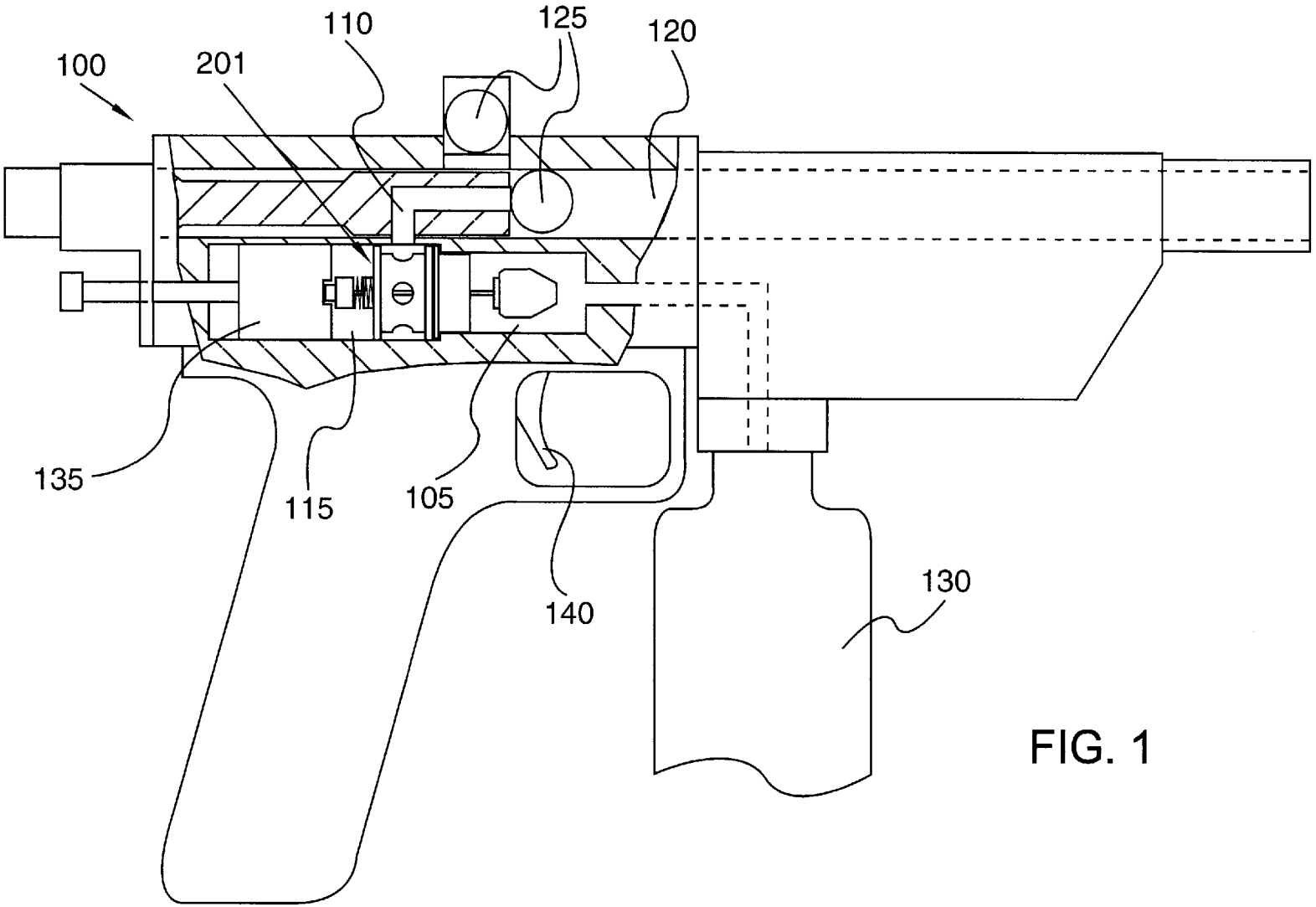
FIG. 1 is a side view, partially in cross section and partially broken away, of a compressed fluid powered device and a preferred embodiment of the invention depicted in FIG. 2.

Referring to FIG. 2 and describing one of the most preferred embodiments, valve 201, in greater detail, portion 200 is a side view of valve 201 located within a partially broken away cross section of compressed fluid powered device 100 of FIG. 1. Valve 201 is mounted within valve chamber bore 115 of compressed fluid powered device 100. Valve 201 most preferably includes valve body 205, valve stem 230, seal 235, strikable portion 245, and spring 250. These components of valve 201 will be described in greater detail hereinafter.

Valve body 205 most preferably includes intake port 210, exhaust ports 215, passageway 220, internal bore 225, seal seat 240, recess 255, rear support appendage 265, and rear support appendage internal bore 270. Intake port 210 most preferably is penannularly cylindrical including an outer concentric surface having a diameter of 0.500 in. and an inner concentric surface having a diameter of 0.300 in. Nevertheless, intake port 210 is in no way limited to this shape or diameters and may be defined by other diameters or shapes. Intake port 210 further includes seal seat 240 located on the inner concentric surface of intake port 210, which will be described hereinafter in conjunction with seal 235.

Exhaust port 215 is most preferably 0.180 in. diameter circular aperture. Nevertheless, exhaust port 215 could be any other shape or size. Exhaust port 215 is most preferably located in recess 255, and connects passageway 220 to recess 255. Although four exhaust ports 215 are most preferred, at least three exhaust ports 215 or at least one exhaust port 215 will suffice as well. One reason for the size of exhaust port 215 is that the combination of preferably four exhaust ports 215 and recess 255 allow a larger volume of pressurized fluid to pass through from passageway 220 to exhaust bore 110 than the prior art valves that utilize only one or two larger exhaust ports.

Passageway 220 is most preferably 0.300 in. diameter cylindrical aperture collinear with the inner concentric surface of intake port 210. Nevertheless, passageway 220 could be any other shape or size. Passageway 220 connects intake port 210 to exhaust ports 215. Length portion 224 of passageway 220 is long enough to optimize a scavenging effect and short enough to minimize surface area drag.

Internal bore 225 is most preferably a 0.090 in. diameter cylindrical aperture. Nevertheless, internal bore 225 could be any other shape or size. Internal bore 225 opens to passageway 220 and to either the outside of valve body 205, or most preferably to rear support appendage internal bore 270. Valve stem 230 slidably is received in internal bore 225.

Recess 255 connects exhaust port 215 to exhaust bore 110. Recess 255 is most preferably a circumferential channel with a width of 0.300 in. Nevertheless, recess 255 could be any other shape or width. Recess 255, along with at least one exhaust port 215, allows a larger volume of fluid to pass from passageway 220 to exhaust bore 110 and provides less restrictive fluid flow.

Rear support appendage 265 is most preferably annularly cylindrical including an outer concentric surface having a diameter of 0.200 in. and an inner concentric surface having a diameter of 0.090 in. In addition, rear support appendage 265 is most preferably 0.150 in. in length. Nevertheless, rear support appendage 265 is in no way limited to these shapes, diameters, or lengths and may be defined by other shapes, diameters, or lengths. The inner concentric surface of rear support appendage 265 defines rear support appendage internal bore 270. Rear support appendage internal bore 270 is coupled to and collinear with internal bore 225, opens to outside of valve body 205, and slidably receives valve stem 230.

Valve stem 230 has a length with a first end and a second end, and is slidably received in rear support appendage internal bore 270 and internal bore 225, and extends at least partially through passageway 220. Valve stem 230 has a predetermined diameter along its length selected to reduce interference with flow of a pressurized fluid and to create a larger volume inside passageway 220. Valve stem 230 is most preferably a cylinder 1.450 in. in length, with a constant diameter of 0.088 in. along its length. Nevertheless, valve stem 230 may be any shape or length, and may have other predetermined diameters that reduce interference with flow of a pressurized fluid and to create a larger volume inside passageway 220. In comparison, valve stem 430 depicted in portion 400 of FIG. 4 includes a two-tiered diameter along its length, wherein the larger diameter tier may partially extend into passageway 420 and reduce the volume of passageway 420, thereby interfering with flow of a pressurized fluid.

Strikable portion 245 is coupled to the first end of valve stem 230. In addition, strikable portion 245 is sized larger than either rear support appendage internal bore 270 and internal bore 225, whereby strikable portion 245 will contact rear support appendage 265, or valve body 205 if rear support appendage is not utilized, after valve stem 230 travels a distance. Strikable portion 245 most preferably is two-tiered and cylindrical, the outermost tier being 0.180 in. in diameter with a length of 0.090 in., and the inner most tier being 0.285 in. in diameter with a length of 0.180 in. Furthermore, on the inside surface of the larger diameter inner most tier facing valve body 205, strikable portion 245 might have circumferential ninety degree recess 247 along its periphery, in which a first end of spring 250 may abut. Nevertheless, strikable portion 245 may be any size, shape, length, or the like and is not restricted to the aforesaid description.

In comparison, valve stem 430 of portion 400 of FIG. 4 does not have strikable portion 245 of FIG. 2, but relies on an end of valve stem 430 to provide a strikable surface. Therefore, when valve stem 430 is struck, it travels into support nose 465 an erratic distance. Furthermore, because of the lack of strikable portion 245 on valve stem 430, the larger diameter tiered portion of valve stem 430 may travel into the passageway a distance, thereby reducing the volume of the passageway.

Figures 6, 7:
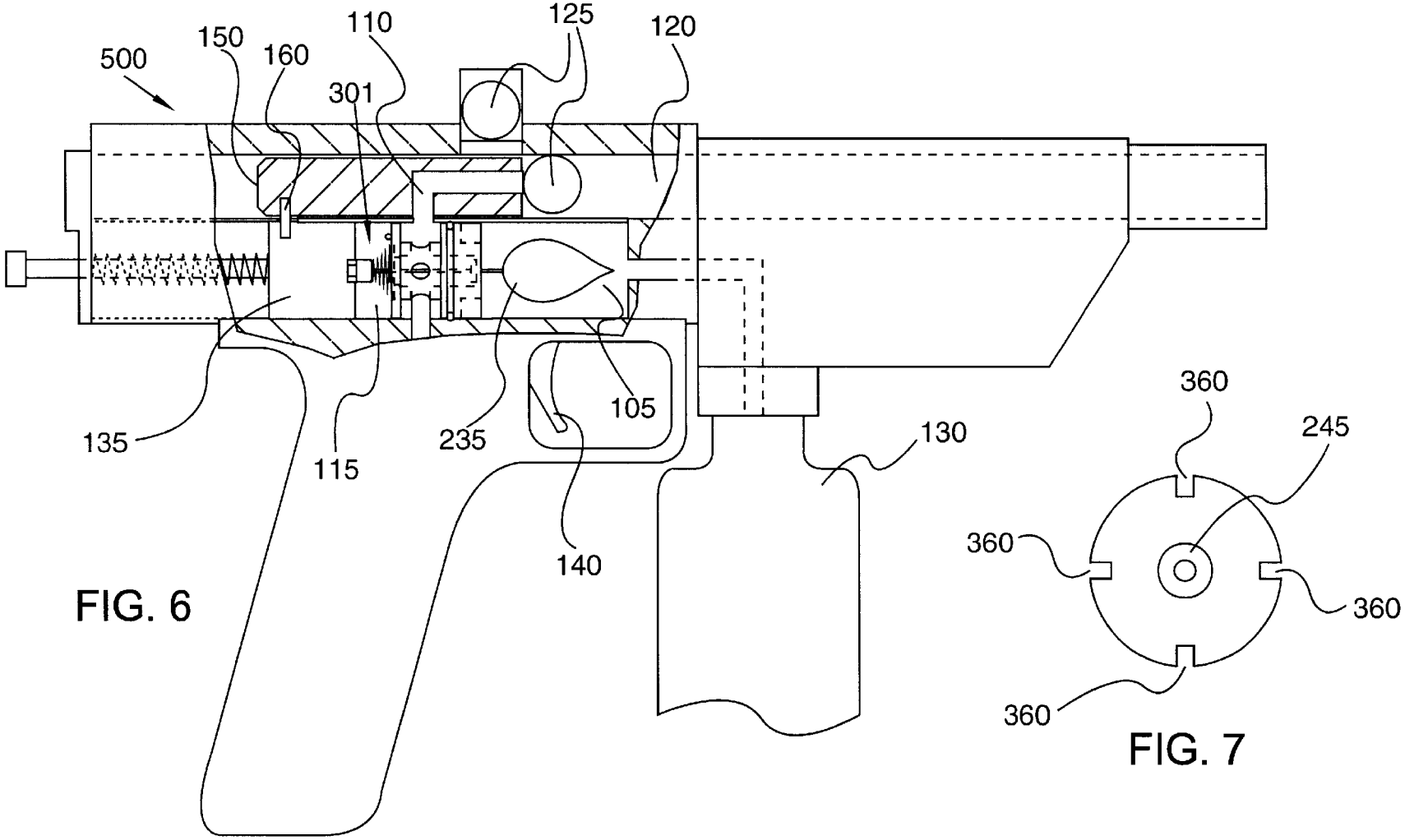
FIG. 6 is a side view, partially in cross section and partially broken away, of a compressed fluid powered device and the preferred embodiment of the invention depicted in FIG. 3.
FIG. 7 is an end view of the preferred embodiment of the invention depicted in FIG. 3.

Preferably seal 235 is aerodynamic. Such an aerodynamic seal might include a substantially spherical portion, such as seal 235 is depicted in FIG. 3. Substantially spherical preferably is defined by a predominate portion of seal 235 being spherical. Preferably there is also an end that terminates in a circumferential bevel suitable for seating with seal seat 240. Another such aerodynamic seal 235 might include a substantially tear-drop shaped portion, such as seal 235 is depicted in FIG. 6. Substantially tear-drop shaped preferably is defined by a predominate portion of seal 235 being tear-drop shaped. Again, preferably there is also an end that terminates in a circumferential bevel suitable for seating with seal seat 240. Most preferably, however, such an aerodynamic seal 235 might include a substantially conical portion, such as seal 235 is depicted in FIG. 2. Substantially conical preferably is defined by a predominate portion of seal 235 being a truncated right circular cone. Preferably the base of the cone blends with a first end of a cylindrical portion and the second end of the cylindrical portion terminates in a smaller diameter due to a circumferential bevel around the periphery of the second end of the cylindrical portion that is suitable for seating with seal seat 240. Preferably, as depicted in FIG. 2, length portion 239 of such a substantially conical seal 235 is short enough to minimize surface area drag, yet long enough to optimize a scavenging effect. Substantially conical seal 235 is preferably 0.400 in. in length and 0.350 in. in width at the cylindrical portion. Nevertheless, it is within the scope of the invention to utilize any aerodynamically shaped seal in conjunction with valve 201 or any other valve within the scope of the present invention, not being restricted to the aforesaid descriptions, definitions, dimensions, or the like.

Seal 235 is coupled to the second end of valve stem 230. Seal 235 is capable of compatibly seating with or unseating from seal seat 240 on intake port 210. Most preferably, seal seat 240 includes small sized circumferential bevel portion 242 on the inner concentric surface of intake port 210 that self centers and facilitates the seating of seal 235, which most preferably has bevel portion 237 that is compatible with bevel portion 242. Preferably, bevel portion 237 and bevel portion 242 are angled at 65 degrees, though they could be at any other angles. Moreover, seal 235 does not have to utilize a bevel portion 237, as discussed hereinafter when stating possible materials seal 235 is made out of.

Spring 250 is between strikable portion 245 and valve body 205. Preferably a first end of spring 250 abuts strikable portion 245 and a second end of spring 250 abuts valve body 205, in which rear support appendage 265 slidably receives the second end of spring 250. Thus, the combination of spring 250 and strikable portion 245 define rear spring assembly 275.

FIG. 2 also depicts the fluid flow path within portion 200. Pressurized fluid enters valve chamber bore 105 and flows around seal 235. Preferably, seal 235 is aerodynamically shaped, allowing fluid flow to be smooth around seal 235 and bevel portion 237, and a scavenging effect to be created. Because of the scavenging effect, fluid then flows at a greater velocity around seal 235 through intake port 210. Seal seat 240 including bevel portion 242 allows for a continuation of the scavenging effect by minimizing turbulence and allowing fluid flow to be smooth. Fluid then travels through passageway 220 and through at least one or more exhaust ports 215 into recess 255, upon which fluid moves into exhaust bore 10. In comparison, FIG. 4 also depicts the fluid flow path within portion 400. However, the non-aerodynamic structure of cupseal 435 and intake port 410 create turbulence, thereby decreasing a scavenging effect and withholding more fluid flow into passageway 420. Moreover, fluid "pop" is created by supersonic fluid as it flows past valve return spring 480 and cupseal 435 into valve body 405. Furthermore, retaining pin 485 must be utilized to keep valve body 405 positioned so exhaust port 415 stays in line with exhaust bore 110.

FIG. 2 further depicts forces F1–F6 exerted by the pressurized fluid during its flow on seal 235, which is depicted with a substantially conical portion blending with a cylindrical portion. Again, seal 235 is aerodynamically shaped, allowing fluid flow to be smooth around seal 235. Because contact surface area on seal 235 is decreased, there are only pressure forces F1 and F4 opposing the opening of seal 235. Moreover, even if seal 235 had a substantially spherical portion, tear-dropped shaped portion, or any other aerodynamic shape within the scope of the present invention, there would be similar pressure forces and fluid flow because of the aerodynamic shapes. In comparison, FIG. 5 depicts a partially broken away cross sectional side view depiction of prior art valve 401. As illustrated in FIG. 5, the combined pressure forces F11, F13, and F15 that are opposing the opening of cupseal 435 are greater than the combined forces F1 and F4 opposing the opening of seal 235. Moreover, when cupseal 435 seats with valve body 405 and valve 401 is shut, fluid pressure on cupseal 435 is amplified because of the non-aerodynamic shape of cupseal 435.

Turning now to FIG. 3, the second most preferred embodiment, valve 301, is depicted. Valve 301 is similar to valve 201 of FIG. 2. Valve 301 most preferably includes valve body 305, valve stem 230, seal 235, strikable portion 245, spring 250, and at least one aperture 360. Components of valve 301 different from those of valve 201 will be described in greater detail hereinafter.

Valve body 305 most preferably includes intake port 210, exhaust port 215, passageway 220, internal bore 225, seal seat 240, recess 255, rear support appendage 265, and rear support appendage internal bore 270. Exhaust port 215 is most preferably located in recess 255, and connects passageway 220 to recess 255. Four exhaust ports 215 are most preferred. With valve 301, retaining pin 385 is inserted into one exhaust port 215 to help retain valve 301 in place, along with retaining pin 386.

Recess 255 connects exhaust port 215 to exhaust bore 110. Recess 255 is most preferably a circumferential channel with a width of 0.300 in. Recess 255 of valve 301 preferably has a depth of 0.205 in. Nevertheless, recess 255 could be any other shape, width, or depth. Recess 255, along with at least one exhaust port 215, allows a larger volume of fluid to pass from passageway 220 to exhaust bore 110 and provides less restrictive fluid flow. Furthermore, it is preferred that recess 255 acts as a reservoir for blow-back fluid that flows forward from striker chamber bore 115, as described in detail hereinafter.

Rear support appendage 265 is most preferably annularly cylindrical including an outer concentric surface having a diameter of 0.200 in. and an inner concentric surface having a diameter of 0.090 in. Rear support appendage 265 of valve 301 preferably has a length of 0.050 in. Nevertheless, rear support appendage 265 is in no way limited to these shapes, diameters, or lengths and may be defined by other shapes, diameters, or lengths.

Seal 235 is depicted with a substantially spherical portion, such as previously described. However, preferably valve 301 would utilize seal 235 with a substantially conical portion blending with a cylindrical portion, as previously described and depicted in FIG. 2. Furthermore, valve 301 might utilize seal 235 with a substantially tear-drop shaped portion, as previously described and depicted on valve 301 in compressed fluid powered device 500 of FIG. 6. Nevertheless, any aerodynamically shaped seal may be utilized in conjunction with valve 301 or any other valve within the scope of the present invention.

At least one aperture 360 most preferably includes a plurality of channels on the outside circumference of valve body 305, possibly four channels as depicted in FIG. 7, with a width of at least 0.020 in., but preferably 0.120 in., and a depth of at least 0.020 in., but preferably 0.120 in. Nevertheless, at least one aperture 360 could be any other shape or size. At least one aperture 360 communicates with valve body 305, preferably communicating with recess 255. This allows fluid to be blown backwards through at least one aperture 360 into striker chamber bore 115 to re-cock striker 135. Moreover, this further allows recess 255 to be a reservoir for blow-back fluid that flows forward from striker chamber bore 115 when striker 135 is actuated and moves to strike strikable portion 245.

Spring 250 is between strikable portion 245 and valve body 305. Preferably, spring 250 is conical, and the smaller diameter first end of spring 250 abuts strikable portion 245 and the larger diameter second end of spring 250 abuts valve body 305 in recess 380. Nevertheless, adjustments to strikable portion 245 and recess 380 could be made such that the smaller diameter first end of spring 250 abuts valve body 305 in recess 380 and the larger diameter second end of spring 250 abuts strikable portion 245. Nevertheless, the combination of spring 250, and strikable portion 245 define rear spring assembly 275. Moreover, recess 380 might be a circular recess with the recess extending across the diameter of the circle and stopping at rear support appendage 265. However, recess 380 preferably is an annularly channeled recess that receives spring 250.

Comparing valve 301 of FIG. 3 with valve 401 of FIG. 4, valve 301 relies on at least one aperture 360 to allow bi-directional movement of fluid—fluid may travel back and re-cock striker 135 and fluid may travel forward into valve body 305 from striker chamber bore 115 after fluid has been blown back. Preferably, when at least one aperture 360 includes a plurality of channels on the outside circumference of valve body 305 and communicates with recess 255 and striker chamber bore 115, fluid from striker chamber bore 115 is allowed to move forward into recess 255 in valve body 305 to eliminate any cushion of fluid pressure that might stop striker 135 from sufficiently or effectively striking strikable portion 245 attached to valve stem 230. Moreover, valve 301 is depicted in FIG. 3 as located within a partially broken away cross section portion 300 of compressed fluid powered device 500 of FIG. 6. If device 500 has a striker chamber exhaust vent 390, plug 391 is employed to stop the dissipation and waste of fluid. By plugging striker chamber exhaust vent 390 with plug 391, low fluid pressures may be used because by allowing blow-back fluid to dissipate forward through at least one aperture 360 into recess 255, more fluid will be blown back through the channels when the valve is next open.

Valve 401 on the other hand relies on either a small slot in the larger diameter tiered portion of valve stem 430, as depicted by dashed line 490, or on small diameter rear blow-back ports around support nose 465 to allow blow back of pressurized fluid into striker chamber bore 115 to re-cock striker 135. However, at low fluid pressures valve 401 utilizing either a small slot in valve stem 430 or rear blow-back ports positioned around support nose 465 cannot re-cock striker 135 by fluid blow-back. Moreover, because of their small sizes, neither the small slot in valve stem 430, nor the small diameter blow-back ports around support nose 465 allow fluid pressure to be released from striker chamber bore 115, thereby creating a cushion of fluid pressure that stops striker 135 from sufficiently or effectively striking valve stem 430. In addition, if striker chamber exhaust vent 390 is utilized to relieve the cushion of pressurized air, the fluid is wasted and there is no recycling of fluid. Also, striker chamber exhaust vent 390 does not solve the problem of re-cocking striker 135 at low fluid pressures.

Valves 201, 301, and any other valve within the scope of the present invention may be made from any of many different types of materials. Preferably, valve body 205, 305, and any other valve body within the scope of the present invention are made from heat treatable stainless steel, though other metals such as aluminum or brass might be used as well. Valve stem 230 is preferably made from high carbon heat treatable steel. Seal 235 is preferably made from DelRin, though Dackron or other malleable plastics might be used. If seal 235 is made from DelRin, Dackron, or other malleable plastics, then bevel portion 237 of seal 235 is optional because such malleable materials will give sufficiently to mold to the shape of bevel portion 242 of seal seat 240, yet be strong and resilient enough to withstand the pressures and forces they are subjected to in valve chamber bore 105. Strikable portion 245 is preferably made from high carbon oil quenched hardened steel. Spring 250 is preferably made from 302 preheat treated stainless steel, but might be made from other preheat treated stainless steel, such as 316 or 17-7, depending on the weight of spring desired. Nevertheless, valves 201, 301, and any other valves within the scope of the present invention might be made from other materials. Moreover, any of these suggested materials or other materials not mentioned may be combined together in any number of ways, and make-up any component, to create valves 201, 301, and any other valve within the scope of the present invention.

The components of valve 201 are preferably manufactured separately and then assembled together. Manufacture of the components defining valve 201 starts with either milling or casting the components. Preferably, the components are milled and may be fashioned in any order. For example, valve body 205 would be milled starting from a stainless steel blank to create the outside components, such as recess 255 and rear support appendage 265. Next, intake port 210 and passageway 220 would be milled. Then exhaust port 215 would be milled in recess 255 through to passageway 220. Similarly, valve stem 230, seal 235, and strikable portion 245 would be milled starting from stainless steel blanks. Another possible subsequent step is sand blasting or polishing the components defining valve 201.

The components of valve 301 are preferably manufactured and assembled like the components of valve 201 as previously described. However, at least one aperture 360 is milled into valve body 305. Moreover, valve 301 might have a ninety degree circumferential portion milled out of the end of valve body 305 along dashed lines 396. In addition, recess 380 is milled into valve body 305.

As stated previously, dimensions of the components of valve 201 may vary, and dimensions may also depend on such factors as what type of device 100 valve 201 is used in, or the sizes of valve chamber bore 105, striker chamber bore 115, or both. Moreover, components of valve 301 and components of other embodiments of the present invention can have different dimensions than those valve 201 might have, again depending on similar factors.

Generally, for assembly of valve 201, 301, and any other valve within the scope of the present invention, spring 250 is slidably received by rear support appendage 265. Seal 235 then is attached to the second end of valve stem 230, followed by inserting the first end of valve stem 230 through intake port 210, through passageway 220, through internal bore 225, through rear support appendage internal bore 270, and through spring 250. Finally, spring 250 is compressed to allow strikable portion 245 to be attached to the first end of valve stem 230. The attachment of strikable portion 245 to valve stem 230 might a screw type attachment. The attachment of seal 235 to valve stem 230 might a pressed barbed type attachment. A possible subsequent step would be to place an O-ring, or some other apparatus, on the valve bodies that will aid in sealing and separating the valve bodies in striker chamber bore 115 from valve chamber bore 105, such as O-ring 395 of FIG. 3.

For the use of valve 201, reference is made to FIGS. 1–2. In FIG. 1, valve 201 of FIG. 2 is shown in conjunction with compressed fluid powered device 100 used for propelling projectiles. Device 100 might be the gun sold under the name SNIPER II AUTO-COCKER by wOrr Game Products, Inc., which is automatically cocked by mechanical means. Device 100 includes valve chamber bore 105 coupled to source of pressure 130; exhaust bore 110 coupled to barrel 120 through which projectiles 125 are propelled; valve chamber bore 105 coupled to exhaust bore 110; valve 201 mounted in valve chamber bore 105 for actuating flow of a pressurized fluid from valve chamber bore 105 to exhaust bore 110; trigger 140 to release striker 135; and striker 135 in striker chamber bore 115 for striking strikable portion 245 coupled to the first end of valve stem 230 to unseat seal 235 from seal seat 240 to allow the pressurized fluid from source of pressure 130 to move through passageway 220 to barrel 120.

Using FIG. 1, the operation of valve 201 will be illustrated. First, trigger 140 is pulled, thereby releasing striker 135. Striker 135 then strikes strikable portion 245, thereby actuating valve 201. Next, compressed fluid from source of pressure 130 flows from valve chamber bore 105 into intake port 210, thereby increasing a scavenging effect and providing more fluid flow into intake port 210. Fluid then flows through passageway 220, out exhaust ports 215, into recess 255, and through exhaust bore 110, the fluid then propelling paintball 125 down and out barrel 120. Finally, valve 201 closes by way of the scavenging effect created and rear spring assembly 275, whereupon striker 135 is automatically re-cocked by mechanical means.

For the use of valve 301, reference is made to FIGS. 3, 6, and 7. In FIG. 6, valve 301 of FIG. 3 is shown in conjunction with compressed fluid powered device 500 used for propelling projectiles. Device 500 of FIG. 6 might be the gun sold under the name SPYDER by Kingman International, which is automatically re-cocked by pressurized fluid blow-back. Device 500 includes valve chamber bore 105 coupled to source of pressure 130; exhaust bore 110 coupled to bolt 150 and barrel 120 through which projectiles 125 are propelled; valve chamber bore 105 coupled to exhaust bore 110; valve 301 mounted in valve chamber bore 105 for actuating flow of a pressurized fluid from valve chamber bore 105 to exhaust bore 110; re-cocking retaining pin 160 for coupling bolt 150 and striker 135 together; trigger 140 to release striker 135; and striker 135 in striker chamber bore 115 for striking strikable portion 245 coupled to the first end of valve stem 230 to unseat seal 235 from seal seat 240 to allow the pressurized fluid from source of pressure 130 to move through passageway 220 to barrel 120.

Using FIG. 6, the operation of valve 301 will be illustrated. First, trigger 140 is pulled, thereby releasing striker 135. Striker 135 then strikes strikable portion 245, thereby actuating valve 301. Next, compressed fluid from source of pressure 130 flows from valve chamber bore 105 into intake port 210, thereby increasing a scavenging effect and providing more fluid flow into intake port 210. Fluid then flows through passageway 220, out at least one exhaust port 215, into recess 255, and through exhaust bore 110, the fluid then propelling paintball 125 down and out barrel 120. Finally, valve 301 closes by way of the scavenging effect created and rear spring assembly 275, whereupon striker 135 is automatically re-cocked by use of fluid pressure, as opposed to mechanical means. As valve 301 is opened and until valve 301 is closed, some fluid also travels through and out at least one aperture 360 into striker chamber bore 115, thereby forcing striker 135 to automatically re-cock. When trigger 140 is pulled again, thereby releasing striker 135, striker 135 then moves forward to strike strikable portion 245 again and dissipates fluid pressure in striker chamber bore 115 forward through and out at least one aperture 360 into valve body 305, preferably recess 255, wherein this fluid pressure may be recycled and utilized to propel paintball 125 when valve 301 is actuated and utilized to re-cock striker 135.

Thus, FIGS. 1–3 and 6–7 illustrate valves that overcome all of the problems associated with prior art valves used in paintball type guns to control the flow of pressurized fluid used to propel paintballs. The valves of the present invention generally include: a valve body that preferably has at least three exhaust ports, which are preferably located in a recess, thereby allowing a larger volume of fluid to pass from the passageway to the exhaust bore and providing less restrictive fluid flow; a valve stem with preferably a predetermined diameter along its length to take up less volume in the passageway and interfering less with the flow of pressurized fluid; a preferably aerodynamic seal that provides for less pressure on the seal, more fluid to flow between the valve chamber bore and the passageway, less turbulence to form, all of which increasing a scavenging effect and providing more fluid flow through the intake port and into the passageway, thus, allowing the valve to be utilized with both high and low fluid pressure; and a strikable portion so that the valve of the present invention does not have to rely on such external factors as fluid pressure, valve return spring pressure, striker spring pressure, and striker weight to regulate the valve.

Moreover, the valves of the present invention are preferably further regulated by a spring between the strikable portion and the valve body. The spring and strikable portion form a rear spring assembly that causes the valve stem to travel a constant distance. This provides a constant amount of fluid volume through the valve, further increasing fluid flow and volume, and further decreasing acoustic irregularities, especially with the use of a preferably aerodynamic seal.

Furthermore, the valves of the present invention might include a plurality of channels on the outside circumference the valve body. The channels allow the dissipation of fluid pressure from a striker chamber bore forward into the recess in the valve body, thereby eliminating any cushion of fluid pressure that might stop the striker from sufficiently or effectively striking the strikable portion attached to the valve stem. In addition, the channels allow a striker chamber exhaust vent to be eliminated, thereby allowing recycling of fluid pressure and not a wasting of fluid pressure by dissipation out the vent. Moreover, the channels allow the use of low fluid pressures to re-cock the striker because by allowing blow-back fluid to dissipate forward through the channels into the valve body, more fluid will be blown back through the channels when the valve is next open.

The embodiments and examples set forth herein were presented in order to best explain the present invention and its practical application and to thereby enable those skilled in the art to make and use the invention. However, those skilled in the art will recognize that the foregoing description and examples have been presented for the purposes of illustration and example only. The description as set forth is not intended to be exhaustive or to limit the invention to the precise form disclosed. Many modifications and variations are possible in light of the above teaching without departing from the spirit and scope of the forthcoming claims.

What is claimed is:

1. A valve comprising:

a valve body comprising an intake port, at least three exhaust ports, a passageway between the intake port and the at least three exhaust ports, and an internal bore opposite the intake port;

a valve stem with a first end and a second end, the valve stem slidably received in the internal bore and extending at least partially through the passageway;

a seal coupled to the second end of the valve stem, wherein the seal is capable of seating with or unseating from a seal seat on the intake port; and a strikable portion coupled to the first end of the valve stem, the strikable portion sized larger than the internal bore, whereby the strikable portion will contact the valve body after the valve stem travels a distance.

2. The valve of claim 1 further comprising a spring, wherein a first end of the spring abuts the strikable portion and a second end of the spring abuts the valve body.

3. The valve of claim 1, wherein the valve body further comprises a circumferential recess, wherein the at least three exhaust ports are located in the recess.

4. The valve of claim 2, wherein the spring is conical.

5. The valve of claim 4, wherein a smaller diameter first end of the conical spring abuts the strikable portion and a larger diameter second end of the conical spring abuts the valve body.

6. The valve of claim 2, wherein the valve body further comprises a rear support appendage having an internal bore coupled to and collinear with the internal bore of the valve body, and wherein the rear support appendage receives the second end of the spring.

7. The valve of claim 1, wherein the valve stem has a length, and wherein the valve stem has a predetermined diameter along its length selected to reduce interference with flow of a pressurized fluid and to create a larger volume inside the passageway of the valve body.

8. The valve of claim 1, wherein the seal is aerodynamic.

9. The valve of claim 8, wherein the seal comprises a substantially spherical portion, a substantially conical portion blending with a cylindrical portion, or a substantially tear-drop shaped portion.

10. A valve comprising:

a valve body comprising a front intake port, at least three exhaust ports located in a circumferential recess, a passageway between the intake port and the at least three exhaust ports, and a rear support appendage with an internal bore;

a valve stem with a first end and a first portion that is slidably received in and extends through the support appendage internal bore, and a second end and a second portion that extends through the passageway and through the intake port;

a seal coupled to the second end of the valve stem, wherein the seal is capable of seating with or unseating from a seal seat on the intake port; and a rear spring assembly comprising a spring and a strikable portion, wherein the strikable portion is coupled to the first end of the valve stem, wherein a first end of the spring abuts the strikable portion and a second end of the spring abuts the valve body.

11. The valve of claim 10, wherein the seal is aerodynamic.

12. A valve comprising:

a valve body comprising an intake port, at least one exhaust port, a passageway between the intake port and the at least one exhaust port, an internal bore opposite the intake port, and a circumferential recess, wherein the at least one exhaust port is located in the recess;

a valve stem with a first end and a second end, the valve stem slidably received in the internal bore and extending at least partially through the passageway;

a seal coupled to the second end of the valve stem, wherein the seal is capable of seating with or unseating from a seal seat on the intake port; and a plurality of channels on an outside circumference of the valve body, wherein the channels communicate with the recess.

13. The valve of claim 12, wherein the seal is aerodynamic.

14. The valve of claim 12, wherein the channels have a width of at least 0.020 inches and a depth of at least 0.020 inches.

15. The valve of claim 12 further comprising a strikable portion coupled to the first end of the valve stem, the strikable portion sized larger than the internal bore, whereby the strikable portion will contact the valve body after the valve stem travels a distance.

16. The valve of claim 15 further comprising a spring, wherein a first end of the spring abuts the strikable portion and a second end of the spring abuts the valve body.

17. The valve of claim 16, wherein the valve body further comprises a rear support appendage having an internal bore coupled to and collinear with the internal bore of the valve body, and wherein the rear support appendage receives the second end of the spring.

18. A device for propelling projectiles by means of pressure comprising:

a valve chamber bore coupled to a source of pressure;

an exhaust bore coupled to a barrel through which projectiles are propelled;

a valve chamber bore coupled to the exhaust bore;

a valve mounted in the valve chamber bore for actuating flow of a pressurized fluid from the valve chamber bore to the exhaust bore, the valve comprising:

a valve body comprising an intake port, at least three exhaust ports, a passageway between the intake port and the at least three exhaust ports, ant an internal bore opposite the intake port;

a valve stem with a first end and a second end, the valve stem slidably received in the internal bore and extending at least partially through the passageway;

a seal coupled to the second end of the valve stem, wherein the seal is capable of seating with or unseating from a seal seat on the intake port; and a strikable portion coupled to the first end of the valve stem, the strikable portion sized larger than the internal bore, whereby the strikable portion will contact the valve body after the valve stem travels a distance; and a striker for striking the strikable portion coupled to the first end of the valve stem to unseat the seal from the seal seat to allow the pressurized fluid to move through the passageway to the barrel.

19. The device of claim 18, wherein the valve further comprises a spring, wherein a first end of the spring abuts the strikable portion and a second end of the spring abuts the valve body.

20. The device of claim 18, wherein the valve body further comprises a circumferential recess, wherein the at least three exhaust ports are located in the recess.

21. The device of claim 20, wherein the valve body further comprises at least one aperture that communicates with the valve body.

22. The device of claim 21, wherein the at least one aperture comprises a plurality of channels on an outside circumference of the valve body, wherein the channels communicate with the recess.

23. The device of claim 19, wherein the spring is conical.

24. The device of claim 23, wherein a smaller diameter first end of the conical spring abuts the strikable portion and a larger diameter second end of the conical spring abuts the valve body.

25. The device of claim 19, wherein the valve body further comprises a rear support appendage having an internal bore coupled to and collinear with the internal bore of the valve body, and wherein the rear support appendage receives the second end of the spring.

26. The device of claim 18, wherein the valve stem has a length, and wherein the valve stem has a predetermined diameter along its length selected to reduce interference with flow of a pressurized fluid and to create a larger volume inside the passageway of the valve body.

27. The device of claim 18, wherein the seal is aerodynamic.

28. The device of claim 27, wherein the seal comprises a substantially spherical portion, a substantially conical portion blending with a cylindrical portion, or a substantially tear-drop shaped portion.

* * * * *